US008463149B2

(12) United States Patent
Murayama

(10) Patent No.: US 8,463,149 B2
(45) **Date of Patent: *Jun. 11, 2013**

(54) IMAGE FORMING APPARATUS

(75) Inventor: Tatsuomi Murayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/427,145

(22) Filed: Mar. 22, 2012

(65) Prior Publication Data

US 2012/0177392 A1 Jul. 12, 2012

Related U.S. Application Data

(63) Continuation of application No. 12/234,365, filed on Sep. 19, 2008, now Pat. No. 8,165,484.

(30) Foreign Application Priority Data

Sep. 21, 2007 (JP) ..... 2007-245542

(51) Int. Cl.
*G03G 15/16* (2006.01)

(52) U.S. Cl.
USPC ..... 399/66; 399/302; 399/314; 399/315; 399/317

(58) Field of Classification Search
USPC ..... 399/66, 302, 314, 315
See application file for complete search history.

(56) References Cited

U.S. PATENT DOCUMENTS 5,469,248 A * 11/1995 Fujiwara et al. ..... 399/314
6,477,339 B1 * 11/2002 Yano et al. ..... 399/66
7,266,316 B2 * 9/2007 Tanonaka ..... 399/45

* cited by examiner

*Primary Examiner* — David Gray
*Assistant Examiner* — Francis Gray
(74) *Attorney, Agent, or Firm* — Canon U.S.A., Inc. I.P. Division

(57) ABSTRACT

At a time for resetting a transfer voltage after a predetermined time period from the performance of ATVC in both a color mode and a monochrome mode, ATVC is performed only in a currently running mode. A transfer voltage in another mode that the ATVC has not been performed at that time is set based on results of the ATVC performed in both the color and monochrome modes and a result of the ATVC performed in the other mode at that time.

8 Claims, 10 Drawing Sheets

IMAGE FORMING APPARATUS

CROSS-REFERENCE TO RELATED APPLICATIONS

This application is a continuation of U.S. patent application Ser. No. 12/234,365 filed Sep. 19, 2008, which claims priority to Japanese Patent Application No. 2007-245542 filed Sep. 21, 2007, each of which is hereby incorporated by reference herein in its entirety.

BACKGROUND OF THE INVENTION

1. Field of the Invention

The present invention relates to an image forming apparatus (e.g., a printer, a copier, a facsimile machine, or a multifunction peripheral) that has a plurality of image bearing members placed along an intermediate transfer portion or a recording material conveying portion and forms an image when the intermediate transfer portion or the recording material conveying portion is separated from part of the image bearing members. In particular, the present invention relates to control of a transfer voltage used in transferring a toner image on an image bearing member.

2. Description of the Related Art

Japanese Patent Laid-Open No. 2005-062642 discloses an image forming apparatus that has a plurality of photosensitive drums placed along an intermediate transfer portion and that executes a color mode in which an image is formed when the intermediate transfer portion, which is a belt member, is in contact with all the photosensitive drums and a black monochrome mode in which an image is formed when the intermediate transfer portion is separated from part of the photosensitive drums. Another image forming apparatus having a similar configuration is disclosed in Japanese Patent Laid-Open No. 2004-117426. This image forming apparatus has a plurality of photosensitive drums placed along a recording material conveying portion and executes a color mode in which an image is formed when the recording material conveying portion is in contact with all the photosensitive drums and a black monochrome mode in which an image is formed when the recording material conveying portion is separated from part of the photosensitive drums. With the image forming apparatus disclosed in either of these patent documents, the longevity of photosensitive drums corresponding to magenta, cyan, and yellow toners, which are not used in forming a black image, can be increased by separation of the intermediate transfer portion or recording material conveying portion from these photosensitive drums during black-image formation.

The above-described image forming apparatus uses a technique for controlling a transfer voltage using the so-called active transfer voltage control (ATVC), which applies a test voltage to a transfer member and sets a transfer voltage at which a predetermined current is passed based on a relationship between voltage and current at that time (see, for example, Japanese Patent Laid-Open No. 5-006112).

For the image forming apparatus described in Japanese Patent Laid-Open No. 2005-062642, the contact state of the intermediate transfer portion and the transfer member when the color mode is executed differs from that when the black monochrome mode is executed. The difference in the contact state changes the impedance of a transfer portion when a black toner image is transferred to the intermediate transfer portion, so it is necessary to set a transfer voltage corresponding to the contact state in each mode. Accordingly, when the transfer voltage is set using the ATVC process described in Japanese Patent Laid-Open No. 5-006112, measuring a current in both modes is needed.

However, measuring a current in both modes requires setting the transfer voltage based on the ATVC process every time the mode is switched, thus resulting in a decrease in productivity.

SUMMARY OF THE INVENTION

The present invention provides a technique for reducing the amount of time required to set a transfer voltage.

According to an aspect of the present invention, an image forming apparatus includes a belt member, a first image bearing member, a first transfer member, a second image bearing member, a second transfer member, an execution portion, a first sensing portion, a second sensing portion, a first setting portion, and a second setting portion. The first transfer member is configured to transfer a toner image from the first image bearing member to the belt member. The second transfer member is configured to transfer a toner image from the second image bearing member to the belt member. The execution portion is configured to execute a first image forming mode in which an image is formed on a recording material when the belt member is in contact with the first and second image bearing members and a second image forming mode in which an image is formed on the recording material when the belt member is separated from the first image bearing member and is in contact with the second image bearing member. The first sensing portion is configured to sense a current passing through the first transfer member when a voltage is applied to the first transfer member. The second sensing portion is configured to sense a current passing through the second transfer member when a voltage is applied to the second transfer member. The first setting portion is configured to sense a current passing through at least one of the first and second transfer members pressing the corresponding image bearing member through the belt member and to set a voltage to be applied to the transfer member during image formation. The second setting portion is configured to set a voltage to be applied to the second transfer member during execution of the first image forming mode based on an output of the second sensing portion when the first setting portion performs an operation for setting a voltage to be applied to the second transfer member during execution of the second image forming mode.

Further features of the present invention will become apparent from the following description of exemplary embodiments (with reference to the attached drawings).

DESCRIPTION OF THE EMBODIMENTS

First Embodiment

Structure of Image Forming Apparatus

An image forming apparatus according to embodiments of the present invention will be described below with reference to the drawings.

Figure 1:
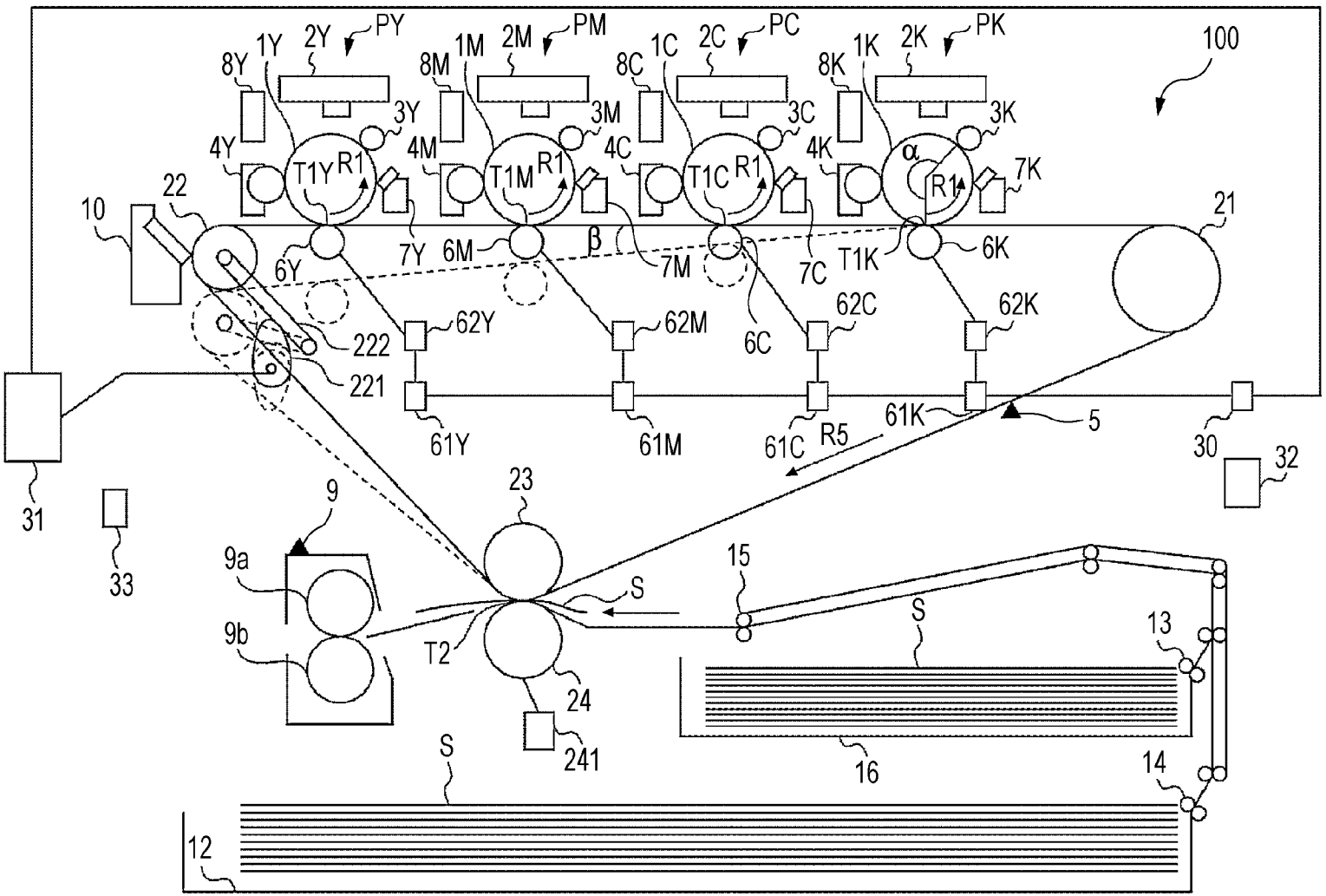
FIG. 1 illustrates a structure of an image forming apparatus according to a first embodiment of the present invention.

FIG. 1 illustrates an image forming apparatus according to a first embodiment of the present invention. The image forming apparatus illustrated in this drawing is an electrophotographic full-color image forming apparatus. FIG. 1 illustrates a longitudinal section that schematically shows a structure of the image forming apparatus. The exemplary structure and operation of the general image forming apparatus will be described below with reference to this drawing.

The image forming apparatus 100 illustrated in this drawing includes image forming portions PY, PM, PC, and PK for forming yellow, magenta, cyan, and black toner images, respectively. The image forming portions have the same structure except that developing devices 4Y, 4M, 4C, and 4K hold different colors of toner. The details of the structure will be described later.

Toner images of different colors formed by the image forming portions PY, PM, PC, and PK are primarily transferred to an intermediate transfer belt 5 in a successive manner, thus forming superimposed toner images. After that, the superimposed toner images are secondarily transferred to a recording material (another member) S, for example, a sheet of paper. The four-color toner image obtained by the secondary transfer is fixed, thus resulting in a full four-color image.

The image forming portions PY, PM, PC, and PK include photosensitive drums (image bearing members) 1Y, 1M, 1C, and 1K, respectively. Each of the photosensitive drums 1Y, 1M, 1C, and 1K is rotatable in the direction of the arrow R1. The photosensitive drums 1Y, 1M, and 1C correspond to a first image bearing member, and the photosensitive drum 1K corresponds to a second image bearing member. Each of the photosensitive drums 1Y, 1M, 1C, and 1K is an aluminum cylinder having an outer diameter of substantially 30 mm with an organic photoconductor (OPC) applied as an outer photosensitive layer. After the surfaces of the photosensitive drums 1Y, 1M, 1C, and 1K are uniformly charged by charging rollers (charging members) 3Y, 3M, 3C, and 3K, respectively, the surfaces are radiated with laser beams from exposure devices 2Y, 2M, 2C, and 2K, respectively, so electrostatic images corresponding to respective colors are formed.

When a negative charging voltage is applied to the charging rollers 3Y, 3M, 3C, and 3K from a charging bias application power source via an electric contact and a core metal in contact therewith, the surface of each of the photosensitive drums 1Y, 1M, 1C, and 1K is uniformly charged to be substantially −600 V. In the present embodiment, the superposition of an AC voltage and a negative DC voltage is used as the charging voltage.

The yellow, magenta, cyan, and black toners are attached to the electrostatic images formed on the photosensitive drums 1Y, 1M, 1C, and 1K by the developing devices 4Y, 4M, 4C, and 4K accommodating their respective colors, so the images are developed as negatively charged toner images.

Toner supply containers 8Y, 8M, 8C, and 8K hold toners to be supplied to the developing devices 4Y, 4M, 4C, and 4K. The toners are supplied thereto by a toner supplying portion (not shown).

The photosensitive drums 1Y, 1M, 1C, and 1K used in the present embodiment is an organic photo conductor, which may have a surface layer having a volume resistivity of $1\times10^{9}$ to $1\times10^{14}$ Ωcm. An amorphous silicon photo conductor can also be used. When the amorphous silicon photo conductor is used, charging for charge-injection becomes possible, so it is effective in preventing generation of ozone and reducing power consumption and it can also improve chargeability.

The intermediate transfer belt 5, which corresponds to a belt member, is disposed below the image forming portions PY, PM, PC, and PK. The intermediate transfer belt 5 is wound around a driving roller 21, a tension roller 22, and an inner secondary transfer roller 23 and is driven by the driving roller 21 so as to be rotated (moved) clockwise (the direction indicated by the arrow R5).

The driving roller 21 is a metallic shaft with a conductive rubber layer applied to its perimeter. The driving roller 21 is adjusted to have a resistance of $1\times10^{3}$ to $1\times10^{5}$Ω, and the shaft is electrically grounded within the image forming apparatus.

Primary transfer rollers 6Y, 6M, 6C, and 6K are disposed inside the intermediate transfer belt 5 and face the photosensitive drums 1Y, 1M, 1C, and 1K, respectively.

The primary transfer rollers 6Y, 6M, and 6C, which correspond to a first transfer member, and the primary transfer roller 6K, which corresponds to a second transfer member, press the intermediate transfer belt 5 from the back side thereof so as to cause the intermediate transfer belt 5 to be in contact with the surface of the photosensitive drums 1. This forms primary transfer portions (transfer portions) T1Y, T1M, T1C, and T1K between the surface of the photosensitive drums 1 and the intermediate transfer belt 5. The angle between the primary transfer portions (transfer portions) T1Y, T1M, T1C, and T1K and the charging rollers 3Y, 3M, 3C, and 3K, respectively, is approximately 240 degrees (the angle α in FIG. 1).

An outer secondary transfer roller 24 is disposed outside the intermediate transfer belt 5 and faces the inner secondary transfer roller 23. The intermediate transfer belt 5 is pressed against the outer secondary transfer roller 24 by the inner secondary transfer roller 23. This forms a secondary transfer portion T2 between the intermediate transfer belt 5 and the outer secondary transfer roller 24.

When a positive primary transfer voltage is applied to the primary transfer rollers 6Y, 6M, 6C, and 6K, the toner images formed on the photosensitive drums 1Y, 1M, 1C, and 1K are thus primarily transferred to the intermediate transfer belt 5 in a successive manner at the primary transfer portions T1Y, T1M, T1C, and T1K, respectively. The primary transfer voltage is applied from primary transfer voltage power sources 61Y, 61M, 61C, and 61K to the corresponding primary transfer rollers 6Y, 6M, 6C, and 6K. This causes four color toner images to be superposed on the intermediate transfer belt 5. Toner remaining on the photosensitive drums 1Y, 1M, 1C, and 1K after the toner images are transferred (transfer residual toner) is removed by cleaning devices 7Y, 7M, 7C, and 7K, and the toner is used to form the next toner images.

Each of the primary transfer rollers 6Y, 6M, 6C, and 6K is composed of a shaft that is made of conductive metal, that has a diameter of approximately 8 mm, and that is covered with a conductive foam having a thickness of approximately 1.0 mm and having a resistance of ~$5.0\times10^6$ [Ω/cm].

The weight of each of the primary transfer rollers 6Y, 6M, 6C, and 6K is approximately 300 g. The primary transfer rollers 6Y, 6M, 6C, and 6K are urged against the back side of the intermediate transfer belt 5 by springs provided on both ends thereof upward in a vertical direction with a total pressure of approximately 5 Kgf to urge the front side of the intermediate transfer belt 5 into contact with the photosensitive drums 1Y, 1M, 1C, and 1K, respectively.

The four color toner images superposed on the intermediate transfer belt 5 are conveyed to the secondary transfer portion T2 with the intermediate transfer belt 5 being rotated in the direction of the arrow R5.

A recording material S (e.g., a sheet of paper or transparency film) accommodated in a paper feed cassette 12 or a paper feed cassette 16 is fed by a paper feed roller 14 or a paper feed roller 13 and is conveyed to a registration roller 15.

The registration roller 15 supplies the recording material S to the secondary transfer portion T2 so as to match with the timing for the four color toner images borne by the intermediate transfer belt 5. While the recording material S passes through the secondary transfer portion T2, a positive secondary transfer bias is applied to the outer secondary transfer roller 24 from a secondary transfer bias application power source 241. This causes the four color toner images on the intermediate transfer belt 5 to be secondarily transferred to the recording material S in a collective manner. Then, the toner images are fixed on the recording material S in a fixing device 9. The fixing device 9 includes a fixing roller 9*a* and a pressing roller 9*b*, and the fixing roller 9*a* and the pressing roller 9*b* form a nip.

The base material of the intermediate transfer belt 5 is a polyimide resin film having a thickness of approximately 85 μm. The intermediate transfer belt 5 contains carbon black distributed therein so that the resistance is adjusted such that the intermediate transfer belt 5 has a surface resistivity of approximately $1\times10^{12}$ Ω/sq. and a volume resistivity of approximately $1\times10^{9}$ Ω·cm. The movement speed of the intermediate transfer belt 5 is approximately 200 mm/sec, and the moving speed of the surface of each of the photosensitive drums 1Y, 1M, 1C, and 1K is approximately 200 mm/sec.

The number of recording materials on which an image is formed is counted by use of a counter 32.

The image forming apparatus according to the present embodiment has the color mode and the black monochrome mode, and different numbers of the photosensitive drums 1 are in contact with the intermediate transfer belt 5 depending on the mode.

The color mode (first image forming mode) is the mode in which a color image is formed when the intermediate transfer belt 5 is in contact with all of the photosensitive drums 1Y, 1M, 1C, and 1K.

The black monochrome mode (second image forming mode) is the mode in which a black image is formed when the photosensitive drums 1Y, 1M, and 1C are separated from the intermediate transfer belt 5 and only the photosensitive drum 1K is in contact with the intermediate transfer belt 5.

When the image forming apparatus is in the stand-by state after power is turned on, the intermediate transfer belt 5 is in the position indicated by solid lines illustrated in FIG. 1 and in contact with all the photosensitive drums 1Y, 1M, 1C, and 1K. When the color mode is selected, as described above, the toner images formed on the photosensitive drums 1Y, 1M, 1C, and 1K are primarily transferred to the intermediate transfer portion and then secondarily transferred to the recording material, thus forming a color image.

Figure 2:
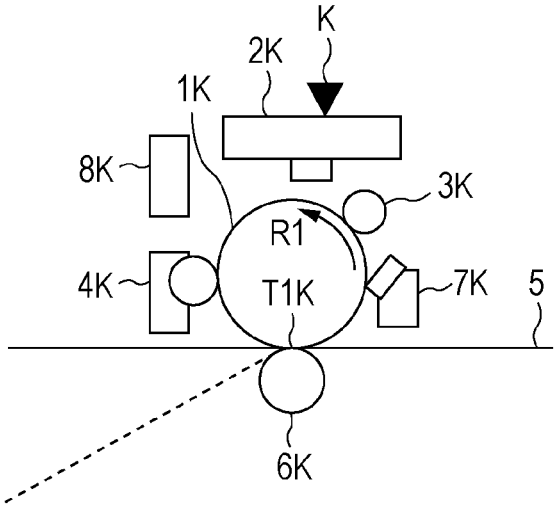
FIG. 2 is an illustration for describing how an intermediate transfer belt is wound around a primary transfer roller.

When the black monochrome mode is selected, a mode selector 31 rotates a cam 221, and a shaking arm 222 coupled to the end of the tension roller 22 is moved downward illustrated in FIG. 1. With the movement of the tension roller 22, the intermediate transfer belt 5 is moved to the position indicated by dashed lines, with the primary transfer roller 6K acting as a pivot, and becomes separated from the photosensitive drums 1Y, 1M, and 1C. In the present embodiment, the movement of the tension roller 22 inclines the surface of the intermediate transfer belt 5 that was in contact with the photosensitive drums 1Y, 1M, 1C, and 1K by approximately 10 degrees (the angle β in FIG. 1). In the present embodiment, in which the intermediate transfer belt 5 is moved such that the primary transfer roller 6K acts as a pivot, as illustrated in FIG. 2, the amount of winding of the intermediate transfer belt 5 on the primary transfer roller 6K in the black monochrome mode is larger than that in the color mode.

When the operation of separating the intermediate transfer belt 5 from the photosensitive drums is completed, a toner image is formed on the photosensitive drum 1K in accordance with the image forming process described above. In the black monochrome mode, the photosensitive drums 1Y, 1M, and 1C are stopped, and no toner images are formed thereon. When the toner image on the photosensitive drum 1K reaches the primary transfer portion T1K, the toner image is primarily transferred to the intermediate transfer belt 5 by the primary transfer roller 6K to which a primary transfer voltage is applied. When the toner image primarily transferred to the intermediate transfer belt 5 reaches the secondary transfer portion T2, the toner image is secondarily transferred to the recording material S by the outer secondary transfer roller 24 to which a secondary transfer voltage is applied. When the image formation is completed, the cam 221 is rotated, so the intermediate transfer belt 5 is returned to the position being in contact with all the photosensitive drums 1Y, 1M, 1C, and 1K.

After the image formation is completed in either the color mode or the black monochrome mode, the intermediate transfer belt 5 being in contact with all the photosensitive drums 1Y, 1M, 1C, and 1K is brought into the stand-by state, and the image forming apparatus waits for the next image formation.

Figure 3:
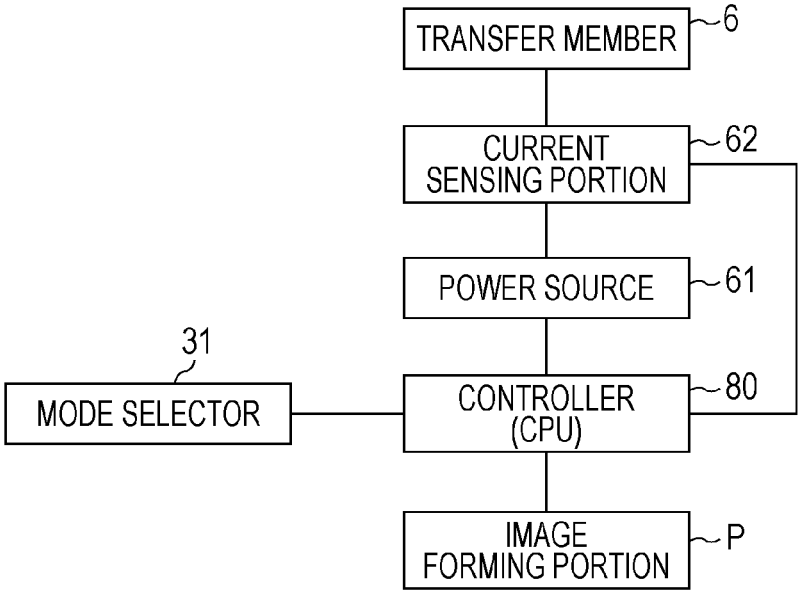
FIG. 3 is a block diagram that illustrates part of the image forming apparatus.

FIG. 3 is a block diagram that illustrates part of the image forming apparatus. The image forming apparatus includes a controller (central processing unit (CPU)) 30. The controller 30 has the function of an execution portion configured to execute a first image forming mode in which an image is formed on a recording material when the belt member is in contact with the first and second image bearing members and a second image forming mode in which an image is formed on the recording material when the belt member is separated from the first image bearing member and is in contact with the second image bearing member. The controller 30 has the function of a setting portion configured to sense a current passing through a transfer member 6 and to set a voltage to be applied to the transfer member 6 during image formation. The controller 30 also has the function of a setting portion configured to set a voltage to be applied to the transfer member 6 facing the separated photosensitive drum for the color mode based on a current passing through the transfer member 6 for transferring a toner image on the photosensitive drum for black in the black monochrome mode, which will be described later. The controller 30 also has the function of a setting portion configured to set a voltage to be applied to the transfer member 6 for transferring a toner image on the photosensitive drum for black in the color mode to the intermediate transfer belt based on a current passing through the transfer member 6 for transferring a toner image on the photosensitive drum for black in the black monochrome mode, which will be described later. The controller 30 also has the function of a setting portion configured to set a voltage to be applied to the transfer member 6 for transferring a toner image on the photosensitive drum for black in the black monochrome mode to the intermediate transfer belt based on a current passing through the transfer member 6 for transferring a toner image on the photosensitive drum for black in the color mode, which will be described later. An example relationship among the controller 30, the power source 61, a current sensing portion 62, the transfer member 6, the mode selector 31, and the image forming portion P is illustrated in FIG. 3.

Primary Transfer Voltage Setting

An example method for setting a primary transfer voltage according to the present embodiment will be described below.

It is difficult to suppress manufacturing variations in resistance of the primary transfer rollers 6. In addition, the resistance changes with a decrease in its durability. When the amount of winding of the intermediate transfer belt 5 on the primary transfer roller 6K increases in switching from the color mode to the black monochrome mode, the impedance of the primary transfer portion T1K reduces.

In the present embodiment, the primary transfer voltage is adjusted so as to respond to changes in resistance and mode selecting using the technique called active transfer voltage control (ATVC).

1. ATVC

Example procedure of ATVC will be first described below. The ATVC is performed in each image forming portion in each mode using substantially the same procedure. In the following description, the suffixes Y, M, C, and K each indicating color of a toner image are omitted to provide general description.

In the ATVC, first, the rotating photosensitive drum 1 is charged so as to have the same potential as in normal image formation with timing other than normal image forming operation. Three different kinds of test voltage (Vt1, Vt2, and Vt3) are sequentially applied from the primary transfer voltage power source 61 to the primary transfer roller 6.

The currents (It1, It2, and It3) passing through the primary transfer roller 6 at that time are sensed by the current sensing portion 62. Then, a voltage-current relationship is derived, a voltage at which a predetermined current (target current) passes is calculated, and the calculated voltage is regarded as the primary transfer voltage. In image forming, this primary transfer voltage is applied to the primary transfer roller 6 using constant voltage control. In the present embodiment, Vt1 is +200 V, Vt2 is +500 V, and Vt3 is +800 V.

Figure 4:
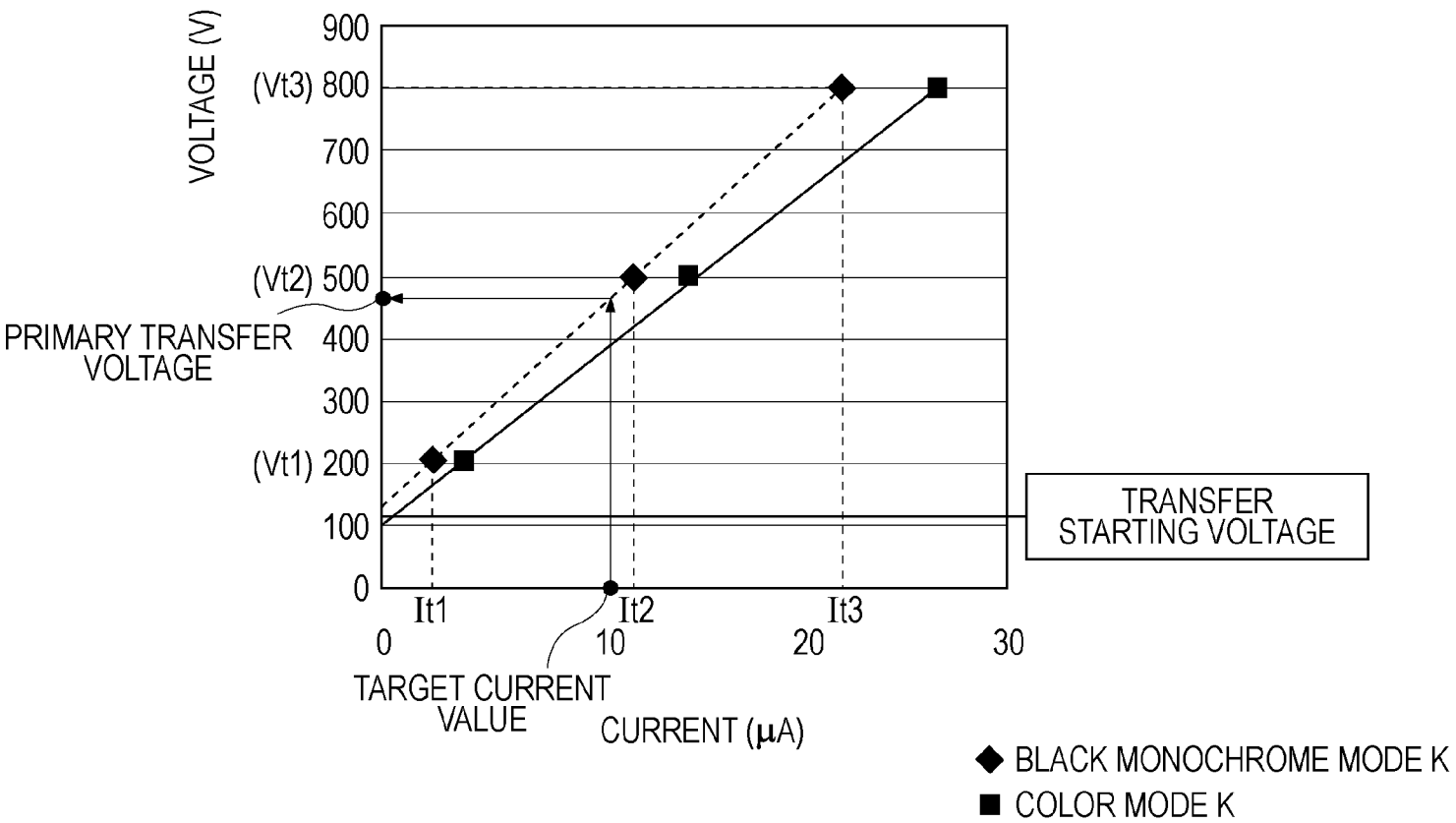
FIG. 4 illustrates one example relationship between voltage and current.

FIG. 4 illustrates one example result of the ATVC according to the present embodiment when the ATVC is performed in the image forming portion PK in the color mode and the black monochrome mode. The plotted points represent values of test voltages and corresponding currents. Because it has been evident by experiment that the voltage-current relationship can be approximated with a straight line when a test voltage at or above a certain voltage (this voltage is referred to as "transfer starting voltage") is applied, intervals between measured points are approximated with a straight line in FIG. 4. Because the impedance of the primary transfer portion T1K for black reduces in switching to the black monochrome mode, the voltage-current relationship in the color mode differs from that in the black monochrome mode in FIG. 4.

Figure 5:
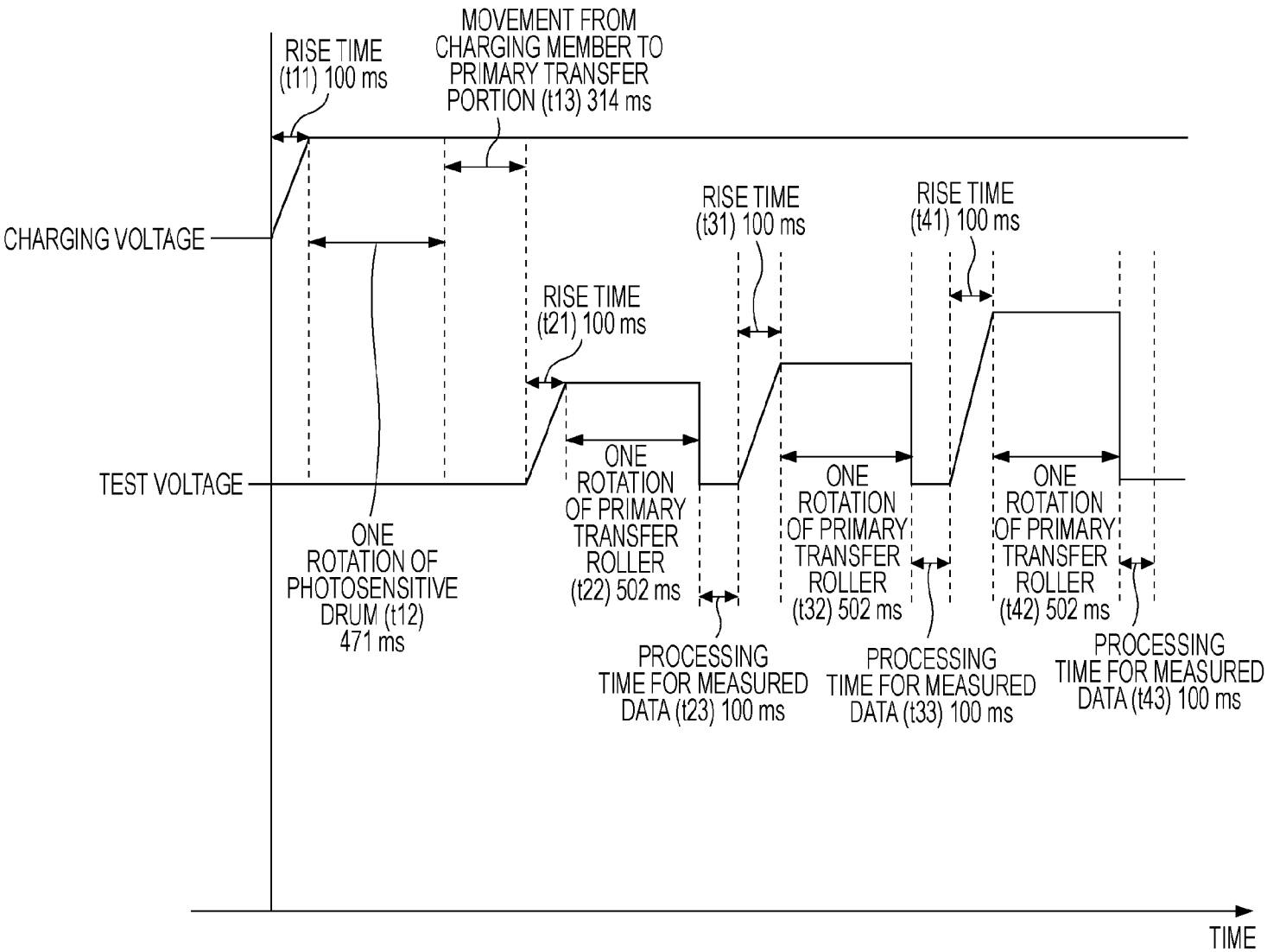
FIG. 5 illustrates a sequence for an ATVC process.

FIG. 5 is a timing chart of the ATVC according to the present embodiment. In the ATVC, first, a charging voltage is applied to the charging roller 3, and the photosensitive drum 1 is charged so as to have −600 V, which is the same as in normal image formation. After the charging voltage is applied, when times t11, t12, and t13 elapse, a first test voltage (Vt1) is applied to the primary transfer roller 6. Time t11 represents the time up to when output of the power source reaches the charging voltage. Time t12 represents the time for one rotation of the photosensitive drum 1 while the charging voltage is charged to the charging roller 3 to stably cause the photosensitive drum 1 to have a desired potential (in the present embodiment, −600 V). Time t13 represents the time up to when a region of the photosensitive drum 1 charged by the charging roller 3 is moved to the primary transfer portion T1.

When time t21 up to when the output of the primary transfer voltage power source 61 reaches the first test voltage elapses, a current passing through the primary transfer roller 6 is sensed. The current is sensed for time t22 for one rotation of the primary transfer roller 6. After the completion of sensing the current for the first test voltage, obtained data is processed (t23).

Subsequently, in a similar manner, a current passing when the second test voltage (Vt2) is applied is sensed, and data is processed (t31, t32, and t33). Finally, a current passing when the third test voltage (Vt3) is applied is sensed, and data is processed (t41, t42, and t43).

2. Initialization Control

Because it is necessary to cause the intermediate transfer belt 5 to come into contact with or be separated from the photosensitive drum when the ATVC is performed in the color mode and the black monochrome mode, the length of time for setting the primary transfer voltage is long.

To address this, at the time for resetting the primary transfer voltage in a predetermined interval (in the present embodiment, 200 sheets printed) after the ATVC is performed in both modes at previous many rotations at power-up of the main body, the ATVC is performed only in the mode currently running at this time. The primary transfer voltage in the other mode at which the ATVC is not performed at this time is reset based on a result of the ATVC performed in the mode currently running at this time by referring to past results of the ATVC performed in both modes.

First, the ATVC performed in both modes immediately after power is turned on will be described.

Figure 6:
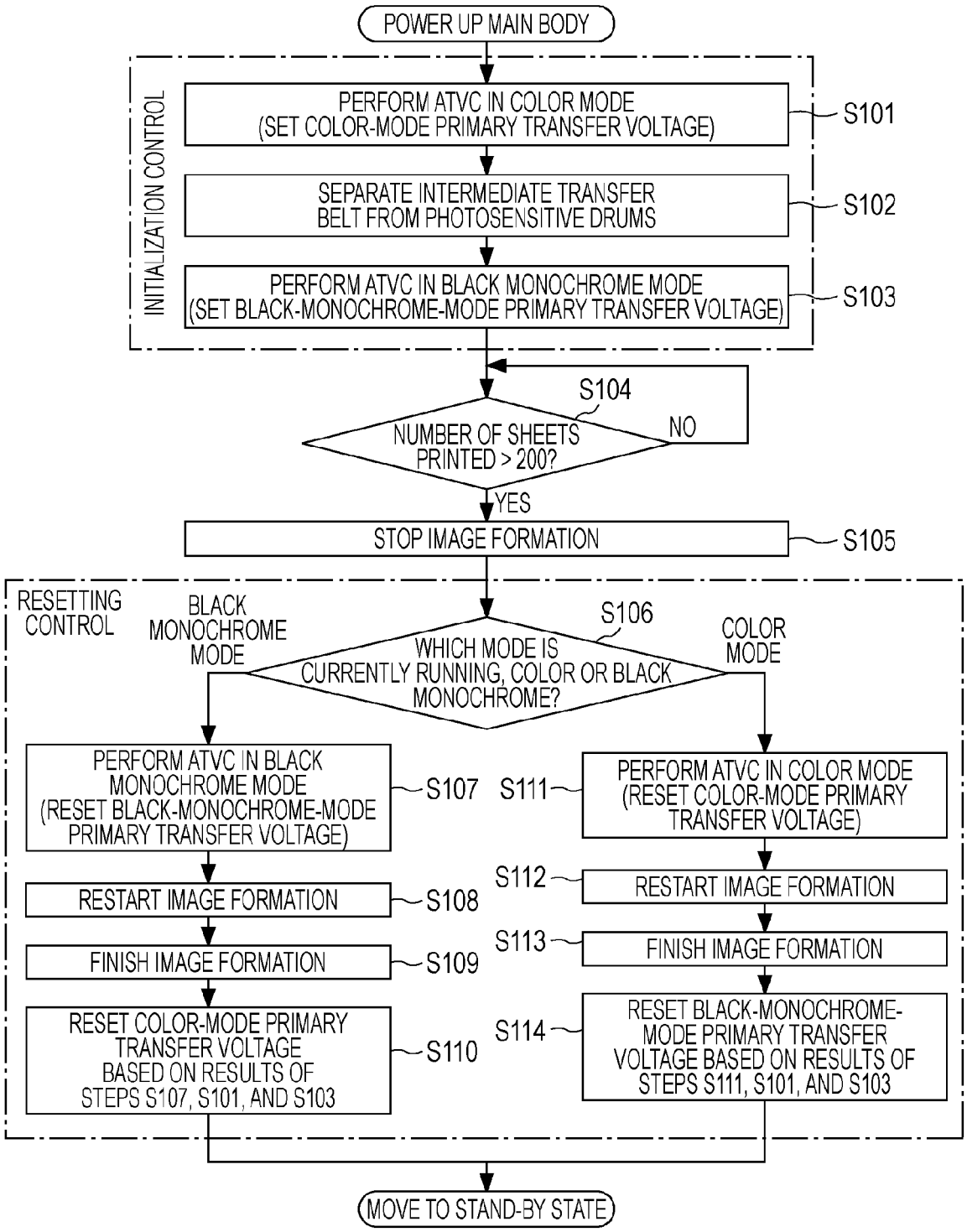
FIG. 6 is a flowchart for setting a primary transfer voltage according to the first embodiment.

Hereinafter, the ATVC performed in both modes is referred to as "initialization control." The description is provided below with reference to FIG. 6. In FIG. 6, steps S101 to S103 are the initialization control.

After power-up of the main body, the ATVC is performed in the image forming portions PY, PM, PC, and PK in the color mode (in which the intermediate transfer belt 5 is in contact with all the photosensitive drums 1).

In step S101, the primary transfer voltages of the image forming portions PY, PM, PC, and PK are determined to be V_pre_y, V_pre_m, V_pre_c, and V_pre_Full_k, respectively, from the voltage-current relationship for each color and the target current for each image forming portion P.

Here, the target current for each image forming portion in the color mode is defined as follows:

PY: I_trg_y

PM: I_trg_m

PC: I_trg_c

PK: I_trg_Full_k

The voltage-current relationship for each color and the primary transfer voltages V_pre_y, V_pre_m, V_pre_c, and V_pre_Full_k are stored in a memory (memory portion) of the controller 30.

Then, in step S102, the intermediate transfer belt 5 is separated from the photosensitive drums, and the image forming apparatus is shifted to the black monochrome mode (the intermediate transfer belt 5 is separated from the photosensitive drums 1Y, 1M, and 1C and in contact with the photosensitive drum 1K), and the ATVC is performed in the image forming portion PK. In step S103, from the voltage-current relationship and the target current (I_trg_mono_k), the primary transfer voltage for the image forming portion PK is set at V_pre_mono_k. Similarly, the voltage-current relationship and the primary transfer voltage V_pre_mono_k are stored in the memory of the controller 30.

3. Resetting Control

After the initialization control, when the total number of sheets printed in the color mode and the black monochrome mode reaches 200, resetting control of resetting the primary transfer voltage is performed. In FIG. 6, steps S106 to S114 are the resetting control.

After the initialization control, when the total number of sheets printed in the color mode and the black monochrome mode reaches 200 (YES in step S104), a continuous image forming job is stopped in step S105, and the primary transfer voltage is reset. In step S106, it is determined which mode is currently running, color or black monochrome. When the black monochrome mode is executed at the time of setting the primary transfer voltage after the initialization control, the ATVC is performed in the black monochrome mode in step S107, and the primary transfer voltage for black for the black monochrome mode is reset to V_mono_k. Then, the voltage-current relationship and the primary transfer voltage V_mono_k are stored in the memory of the controller 30. After the primary transfer voltage is reset, the image formation is restarted in step S108. When the remaining image printing is finished and thus the image formation is completed in step S109, in step S110 the transfer voltage for the color mode is reset based on the results of the initialization control and step S107. An example method will be specifically described below.

It has been found that the voltage-current relationship is represented by a linear expression, as described with reference to FIG. 4. Here, it is assumed that the relationship between primary transfer voltages and target currents for each image forming portion P in each mode is represented as follows:

$$[\text{Black Monochrome Mode, Black}]\ V_pre_mono_k = a \times I_trg_mono_k + b \qquad \text{Equation A}$$

$$[\text{Color Mode, Black}]\ V_pre_Full_k = c_k \times I_trg_Full_k + d_k \qquad \text{Equation B}$$

$$[\text{Color Mode, Yellow}]\ V_pre_y = c_y \times I_trg_y + d_y \qquad \text{Equation C}$$

$$[\text{Color Mode, Magenta}]\ V_pre_m = c_m \times I_trg_m + d_m \qquad \text{Equation D}$$

$$[\text{Color Mode, Cyan}]\ V_pre_c = c_c \times I_trg_c + d_c \qquad \text{Equation E}$$

In the equations A, B, C, D, and E, b, d_k, d_y, d_m, and d_c represent transfer starting voltages for image forming portions P in each mode. It has been found that the transfer starting voltage varies with the contact state of the primary transfer roller 6 and the intermediate transfer belt 5 and the influence of changes in resistance of the primary transfer roller 6 is small.

The relationship between the primary transfer voltage and the target current for [Black Monochrome Mode, Black] obtained from the ATVC in step S107 is represented below.

$$V_mono_k = a' \times I_trg_mono_k + b \qquad \text{Equation F}$$

Figure 7:
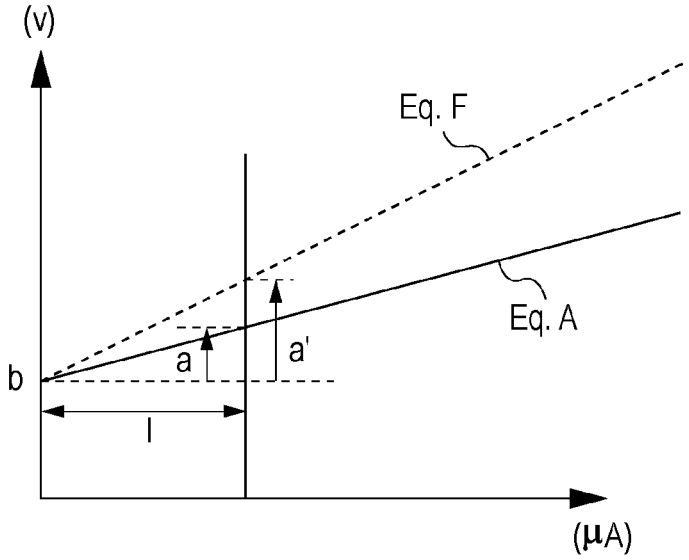
FIG. 7 is an illustration for describing control according to the first embodiment in detail.

FIG. 7 illustrates an example relationship between the equations A and F. Comparison between these two equations shows that the slope of the straight line representing the voltage-current relationship of the image forming portion PK in the black monochrome mode is changed from a to a'. The change of the slope from a to a' represents the change in resistance of the primary transfer roller 6K. The slope, c_k, of the straight line representing the voltage-current relationship of the image forming portion PK in the full color mode (equation B) is also changed by a similar degree by printing of 200 sheets.

Figure 8:
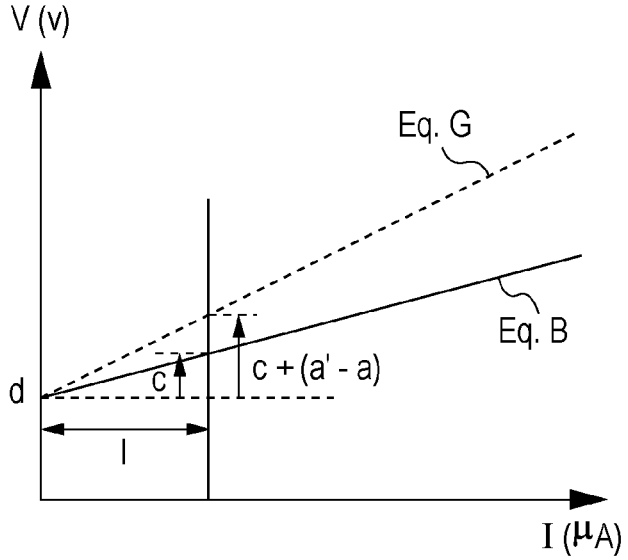
FIG. 8 is an illustration for describing control according to the first embodiment in detail.

The reset value V_Full_k of the primary transfer voltage of the image forming portion PK in the color mode is determined based on Equation G provided below. Equation G is determined from the equations A and F. FIG. 8 illustrates an example relationship between the equations B and G.

$$V_Full_k = \{c_k + (a' - a)\} \times I_trg_Full_k + d_k \qquad \text{Equation G}$$

Next, an example method for resetting the primary transfer voltage of each of the image forming portions PY, PM, and PC will be described.

Figure 9:
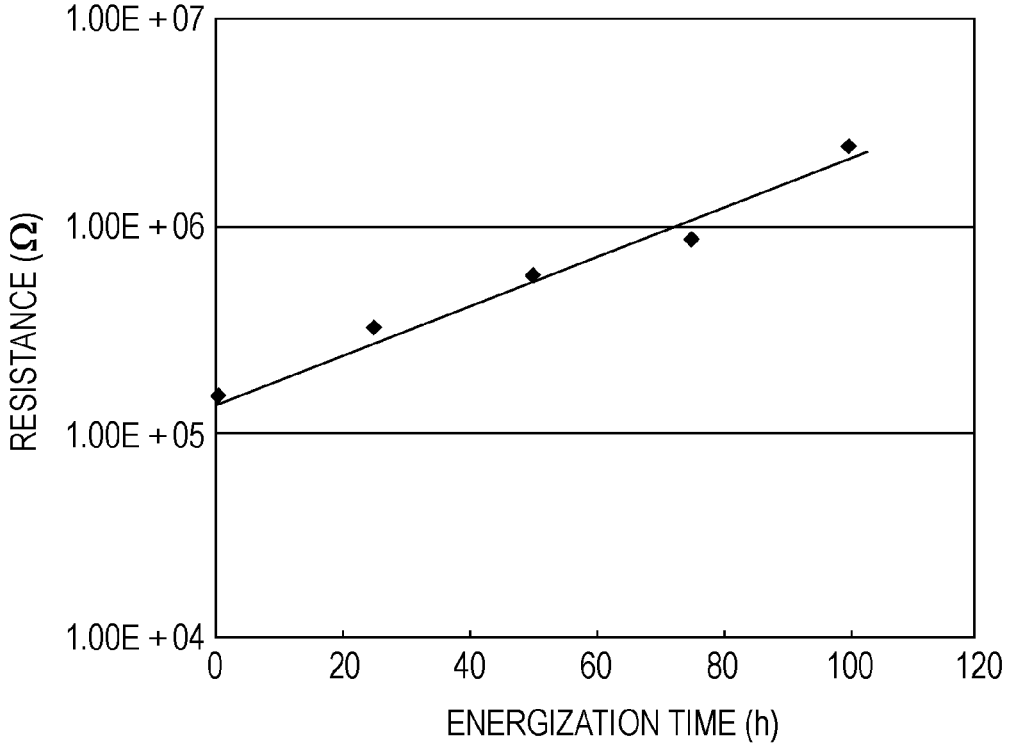
FIG. 9 illustrates changes occurring when a primary transfer roller is energized.

Because the primary transfer voltage is not applied to the primary transfer rollers 6Y, 6M, and 6C during execution of the black monochrome mode, the resistance is not changed. FIG. 9 illustrates changes in resistance of the primary transfer roller 6 with an increase in the time for applying the primary transfer voltage. From FIG. 9, it is found that the energization time and resistance maintain a certain proportional relation.

In consideration of the ratio of printed sheets in the color mode to 200 printed sheets, from the degree of the changes in resistance of the primary transfer roller 6K (changes in slope from a to a') obtained from the comparison between the equations A and F, the changes in resistance of the primary transfer rollers 6Y, 6M, and 6C during this period are calculated. From the changes in resistance of the primary transfer rollers 6Y, 6M, and 6C and the voltage-current relationship obtained in the initialization control (equations C, D, and E), the reset values are determined. Specifically, the reset values V_y, V_m, and V_c of the primary transfer voltages for the image forming portions PY, PM, and PC in the color mode are determined from equations H, I, and J below.

$$V_y = \{c_y + (a' - a) \times (h/g)\} \times I_trg_y + d_y \qquad \text{Equation H}$$

$$V_m = \{c_m + (a' - a) \times (h/g)\} \times I_trg_m + d_m \qquad \text{Equation I}$$

$$V_c = \{c_c + (a' - a) \times (h/g)\} \times I_trg_c + d_c \qquad \text{Equation J}$$

Next, a case will be described in which, at the time of setting the primary transfer voltage after the initialization control, the color mode is being executed. In this case (color mode in step S106), the ATVC is performed in step S111. The primary transfer voltages for the image forming portions PY, PM, PC, and PK in the color mode are reset to V_y, V_m, V_c, and V_mono_k, respectively. The voltage-current relationship and the primary transfer voltages V_y, V_m, and V_c are stored in the memory of the controller 30. After the primary transfer voltages are reset, in step S112, the image formation is restarted in step S112. When the remaining image printing is finished and thus the image formation is completed in step S113, the primary transfer voltage for the black monochrome mode is reset in step S114. The primary transfer voltage for the black monochrome mode is reset based on the results of the initialization control and step S111, similar to the case in which the black monochrome mode is being executed at the time of resetting, which is previously described above.

The relationship between the primary transfer voltage V_Full_k of the image forming portion PK in the color mode and the target current I_trg_Full_k obtained from the ATVC performed in step S111 is assumed to be represented by the following equation.

$$V_Full_k = c_k' \times I_trg_Full_k + d_k \quad \text{Equation K}$$

By use of a method similar to step S110, the reset value V_mono_k of the primary transfer voltage for the image forming portion PK in the black monochrome mode is determined based on the following equation L.

$$V_mono_k = \{a + (c_k' - c_k)\} \times I_trg_mono_k + b \quad \text{Equation L}$$

In such a way, the time for setting the primary transfer voltage can be reduced in the image forming apparatus having the black monochrome mode at which an image is formed when the intermediate transfer belt 5 is separated from the photosensitive drums 1Y, 1M, and 1C of the image forming portions PY, PM, and PC.

When 200 sheets are further printed from the resetting control, the resetting control at the second time is performed. Also in the second-time resetting control, the ATVC is performed only in the mode running at this time. The transfer voltage is reset based on this result and the result of the initialization control.

Specific Example of Primary Transfer Control

Specific set values obtained from the primary transfer voltage according to the present embodiment are provided below.

In the present embodiment, when power was turned on and the initialization control was performed, the main body was placed under environment of temperature 23° C. and humidity 50%. The primary transfer voltage is shown in Table 1.

TABLE 1

| | Mode | | | | |
|---|---|---|---|---|---|
| | Black Monochrome Mode | Color Mode Image Forming Portion | | | |
| | PK | PK | PY | PM | PC |
| Target Current | I_trg_mono_k = 11 μA | I_trg_Full_k = 9 μA | I_trg_y = 11 μA | I_trg_m = 10 μA | I_trg_c = 10 μA |
| Primary Transfer Voltage | V_pre_mono_k = 478 V | V_pre_Full_k = 342 V | V_pre_y = 395 V | V_pre_m = 368 V | V_pre_c = 370 V |

At this time, the equations of the voltage-current relationship for the image forming portions PY, PM, PC, and PK in each mode are shown below. This time, the values c_k, c_y, c_m, and c_c were the same.

$$V_pre_mono_k = 32.53 \times I_trg_mono_k + 120.2$$

$$V_pre_Full_k = 26.33 \times I_trg_Full_k + 105.2$$

$$V_pre_y = 26.33 \times I_trg_y + 104.1$$

$$V_pre_m = 26.33 \times I_trg_m + 111.0$$

$$V_pre_c = 26.33 \times I_trg_c + 106.2$$

Assuming that the ratio of sheets printed in the full color to those in mono color in 200 sheets printed thereafter was 7:3, the voltage-current relationship obtained from the performance of the ATVC in the black monochrome mode at the time of resetting was as follows:

$$V_mono_k = 30.18 \times I_trg_mono_k + 118.4 \quad \text{Equation M}$$

From the equation M and the result of the initialization control, the following equation Q was obtained.

$$V_Full_k = 23.98 \times I_trg_Full_k + 105.2 \quad \text{Equation Q}$$

When the primary transfer voltage for the color mode was reset using the equation Q, V_Full_k was 320.9 V. It is found that, when a voltage of 320.9 V was applied to the primary transfer roller 6K in the color mode, a current of 9.2 μA, which was substantially the same as the target current I_trg_Full_k, passed. This shows that the control according to the present embodiment is effective.

The voltage-current relationship of the image forming portions PY, PM, and PC obtained from the equation M and the result of the initialization control is shown below.

$$V_y = 24.68 \times I_trg_y + 104.1 \quad \text{Equation R}$$

$$V_m = 24.68 \times I_trg_m + 111.0 \quad \text{Equation U}$$

$$V_c = 24.68 \times I_trg_c + 106.2 \quad \text{Equation W}$$

When the primary transfer voltages for the image forming portions PY, PM, and PC were reset using the equations R, U, and W, the following values were obtained.

$$V_y = 375.6 \text{ V}$$

$$V_m = 357.8 \text{ V}$$

$$V_c = 353.0 \text{ V}$$

When the obtained primary transfer voltages were applied to the primary transfer rollers 6Y, 6M, and 6C in the color mode, the following current values Iy, Im, and Ic for the primary transfer rollers 6Y, 6M, and 6C were obtained.

$$Iy = 11.5 \text{ μA}$$

$$Im = 10.4 \text{ μA}$$

$$Ic = 9.9 \text{ μA}$$

The values are substantially the same as the respective target current values. This shows that the control according to the present embodiment of the present invention is correct.

Second Embodiment

Figure 10A:
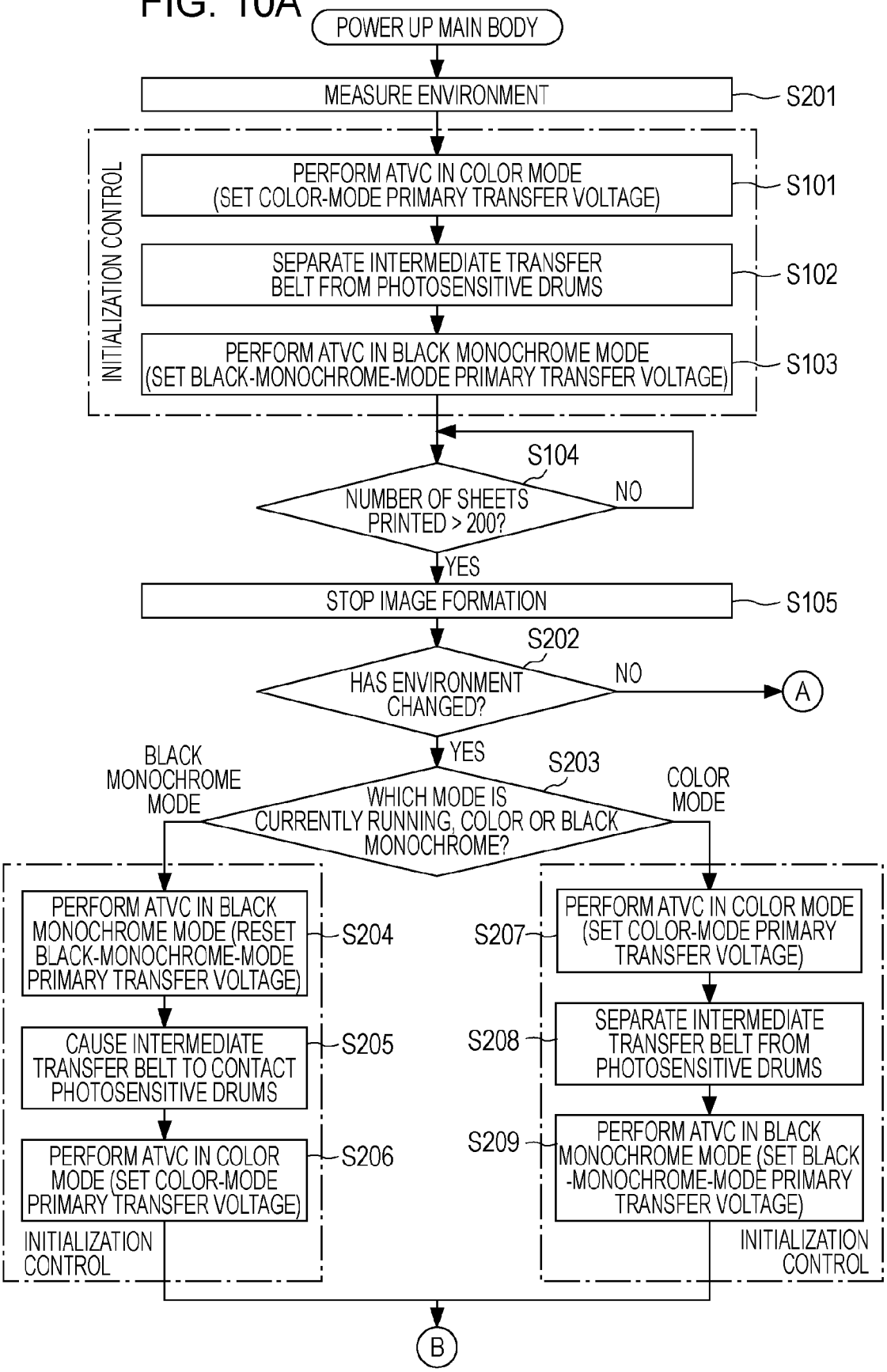
FIGS. 10A and 10B is flowchart for setting a primary transfer voltage according to a second embodiment of the present invention.
Figure 10B:
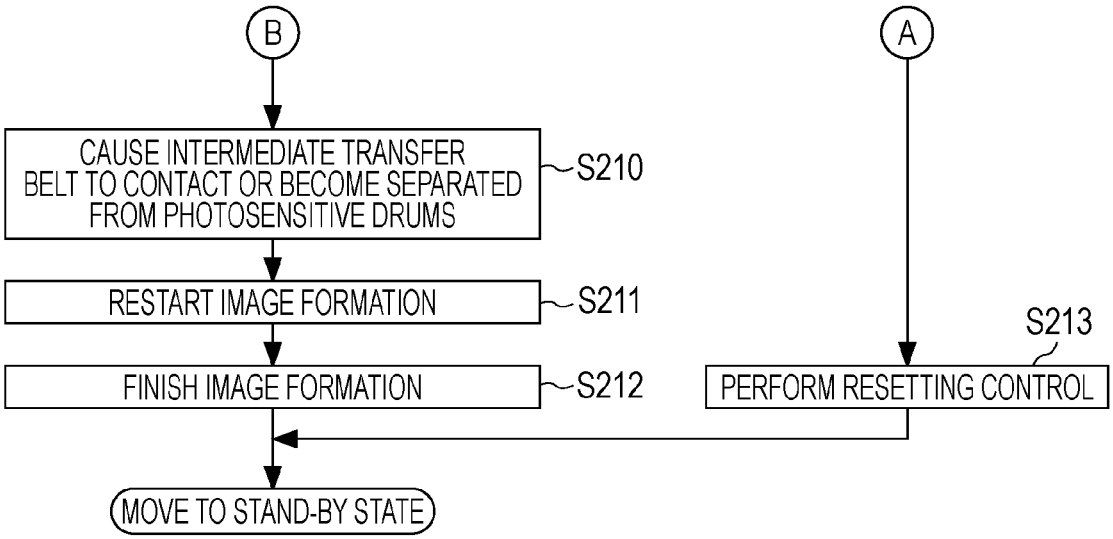

An image forming apparatus according to a second embodiment of the present invention is one in which an environmental sensor 33 for detecting temperature and humidity is provided to the image forming apparatus according to the first embodiment illustrated in FIG. 1. When the temperature and humidity at the time of resetting the primary transfer voltage differ from those in the initial settings, the initialization control is performed again in place of the resetting control. This is because it is difficult to predict changes in resistance of the primary transfer roller 6 caused by environmental variations. FIGS. 10A and 10B illustrate a control sequence according to the present embodiment. A detailed description is provided below.

The environmental sensor 33 measures the temperature and humidity when the main body is powered up.

The controller 30 determines whether the present environment is a hot and humid environment (humidity: 70% or more, temperature: 28° C. or more), a normal environment (humidity: 5% or more, temperature: 18° C. or more), or a dry environment (humidity: less than 5%). The result (detection result) is stored in the memory of the controller 30 (step S201).

Then, the initialization control is performed in steps S101 to S103, as in the first embodiment. When the number of sheets printed thereafter reaches 200, the image formation is stopped in step S105, the environmental sensor 33 measures the temperature and humidity again and the determination of the environment is made. If the environment is determined to be different from that in the initialization control (YES in step S202), processing proceeds to step S203. In step S203, it is determined which mode is currently running, color or black monochrome. If the currently running mode is the black monochrome mode, the ATVC is first performed in the black monochrome mode and the primary transfer voltage for the black monochrome mode is set in step S204. After the setting, when the intermediate transfer belt 5 comes into contact with the photosensitive drums 1Y, 1M, and 1C in step S205, the ATVC is performed in the color mode and the primary transfer voltage for the color mode is set in step S206. After the completion of setting the primary transfer voltage in both modes, the intermediate transfer belt 5 is separated from the photosensitive drums 1Y, 1M, and 1C in step S210, and the image formation is restarted in step S211. After the image formation is completed in step S212, the image forming apparatus is shifted to the stand-by state. If the currently running mode at the time of performing the initialization control again is the color mode in step S203, the ATVC is first performed in the color mode in step S207. When the intermediate transfer belt 5 is separated from the photosensitive drums 1Y, 1M, and 1C in step S208, the ATVC is performed in the black monochrome mode in step S209. After the completion of setting the primary transfer voltage in both modes, the intermediate transfer belt 5 comes into contact with the photosensitive drums 1Y, 1M, and 1C in step S210, and the image formation is restarted in step S211. After the image formation is completed in step S212, the image forming apparatus is shifted to the stand-by state.

After that, when 200 sheets are further printed, the time for performing the resetting control comes again, but if the temperature and humidity at this time differs from the environment occurring when the immediately preceding initialization control was performed, the initialization control is performed again. In contrast, if the environment does not vary from that occurring when the immediately preceding initialization control was performed, the resetting control described in the first embodiment is performed while referring to the result of the immediately preceding initialization control.

In step S202, if it is determined that there is no variation in the environment from that occurring when the initialization control was performed (NO in step S202), the resetting control described in the first embodiment is performed in step S213, and then the image forming apparatus is shifted to the stand-by state.

As described above, the detection can be performed with high precision regardless of environmental changes in the image forming apparatus in which an image can be formed when the intermediate transfer belt 5 is separated from part of the photosensitive drums 1 and control for reducing the time for setting a primary transfer is performed.

Third Embodiment

Figure 11:
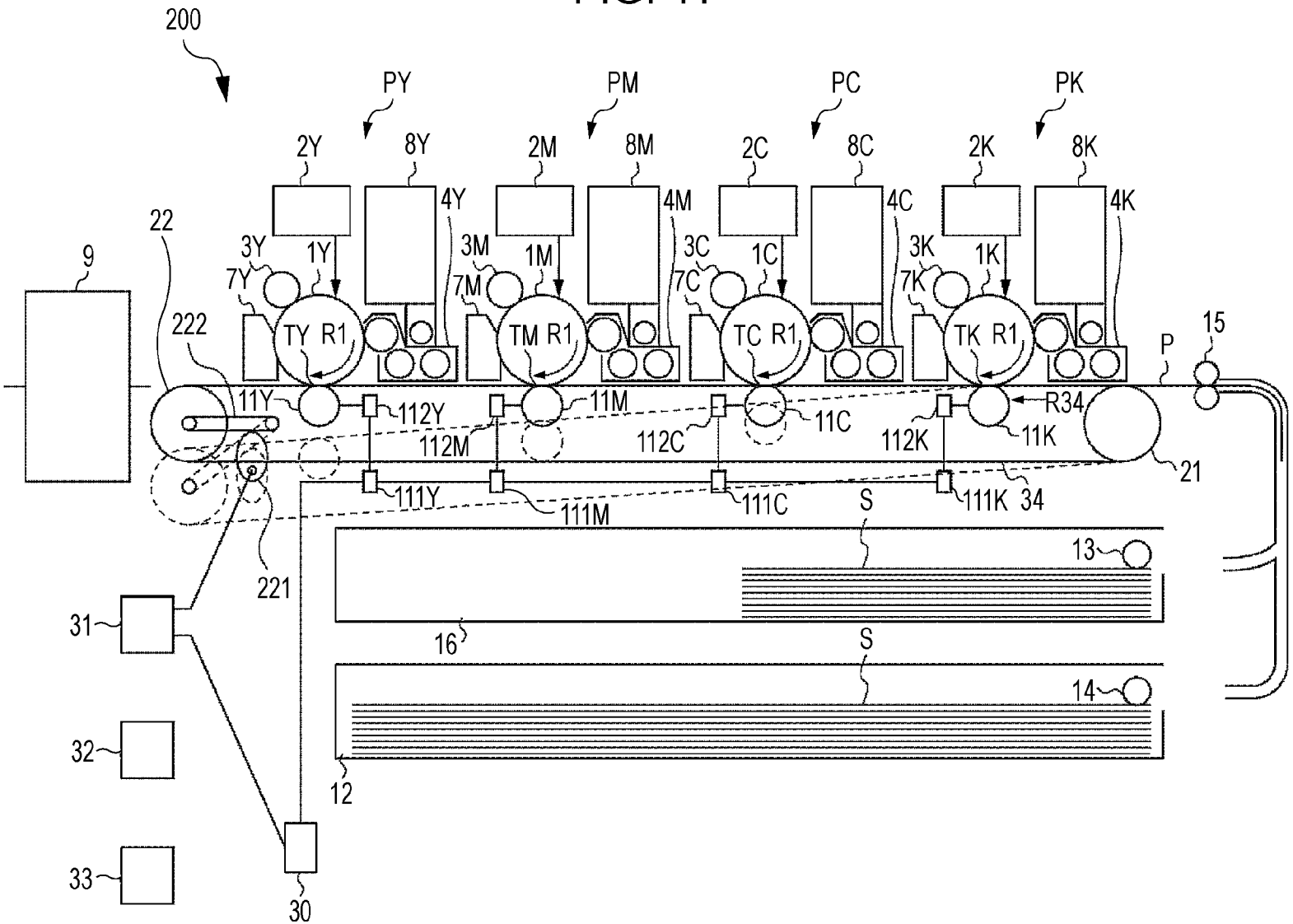
FIG. 11 illustrates a structure of an image forming apparatus according to a third embodiment of the present invention.

FIG. 11 illustrates a structure of an image forming apparatus according to a third embodiment of the present invention.

The image forming apparatus 200 according to the third embodiment is substantially the same as the image forming apparatus in the first and second embodiments, except that a toner image is directly transferred to a recording material from the photosensitive drums 1 at the image forming portions PY, PM, PC, and PK. Therefore, in FIG. 11, the same reference numerals are used for the same components as in FIG. 1, and redundant description is omitted.

As illustrated in FIG. 11, in the image forming apparatus 200, the image forming portions PY, PM, PC, and PK used in the image forming apparatus according to the first and second embodiments are disposed along a recording-material bearing belt 34 rotatable in the direction of the arrow R34.

In the image forming portions PY, PM, PC, and PK of the image forming apparatus 200, a negatively charged toner image is formed on each of the respective photosensitive drums 1. The toner images are directly transferred to the recording material S borne on the recording-material bearing belt 34 at the transfer portions TY, TM, TC, and TK.

The recording material S to which the toner images are transferred at the transfer portions TY, TM, TC, and TK is then conveyed to a fixing device 9, and the toner images are fixed. Transfer rollers 11Y, 11M, 11C, and 11K urge the recording-material bearing belt 34 from the back side thereof such that the front side of the recording-material bearing belt 34 is brought into contact with the surface of the photosensitive drums 1. This forms the transfer portions TY, TM, TC, and TK between the surface of the photosensitive drums 1 and the recording-material bearing belt 34. When a positive transfer voltage is applied to the transfer rollers 11Y, 11M, 11C, and 11K from transfer power sources 111Y, 111M, 111C, and 111K, the toner images on the photosensitive drums 1Y, 1M, 1C, and 1K are transferred to the recording material S.

The image forming apparatus 200 is operable in the color mode and the black monochrome mode, as in the case of the image forming apparatus 100. The color mode is the mode in which a color image is formed when the recording-material bearing belt 34 is in contact with all the photosensitive drums 1Y, 1M, 1C, and 1K. The black monochrome mode is the mode in which a black image is formed when the recording-material bearing belt 34 is separated from the photosensitive drums 1Y, 1M, and 1C and in contact with only the photosensitive drum 1K.

In the stand-by state after the image forming apparatus is powered up, the recording-material bearing belt 34 is in the position indicated by the solid lines illustrated in FIG. 11 and is in contact with all the photosensitive drums 1Y, 1M, 1C, and 1K. When the color mode is selected, the toner image formed on each of the photosensitive drums 1Y, 1M, 1C, and 1K is transferred to the recording material S borne on the recording-material bearing belt 34 (P). When the black monochrome mode is selected, the tension roller 22 is moved downward. With the movement of the tension roller 22, the recording-material bearing belt 34 is moved to the position indicated by the dashed lines such that the transfer roller 11K acts as a pivot and becomes separated from the photosensitive drums 1Y, 1M, and 1C. At this time, the amount of winding of the recording-material bearing belt 34 on the transfer roller 11K is larger than that in the color mode.

After the image formation is completed in either the color mode or the black monochrome mode, the recording-material bearing belt 34 being in contact with all the photosensitive drums 1Y, 1M, 1C, and 1K is brought into the stand-by state, and the image forming apparatus waits for the next image formation.

Also in the image forming apparatus 200, as illustrated in the first and second embodiments, the transfer voltage is controlled using the ATVC technique. When the test voltage is applied from the transfer power sources 111Y, 111M, 111C, and 111K, a current is sensed by current sensing portions 112Y, 112M, 112C, and 112K.

The control performed in the present embodiment is the control in which the intermediate transfer belt and the primary transfer voltage described in the control illustrated in FIGS. 5 and 10 are replaced with the recording-material bearing belt and the transfer voltage, respectively.

In such a way, the time for setting the transfer voltage can be reduced also in the image forming apparatus in which the recording material conveying member becomes separated from part of the photosensitive drums 1 and the transfer voltage is controlled using the ATVC technique. The control can be performed with high precision regardless of environmental changes.

In the image forming apparatus according to the first to third embodiments, the primary transfer voltage and the transfer voltage are set based on the current passing when the test voltage is applied. However, the primary transfer voltage and the transfer voltage can be set based on the voltage occurring when the test current is applied to the primary transfer roller 6 or the transfer roller 11.

As described above, according to the embodiments of the present invention, the time for setting a transfer voltage can be reduced in an image forming apparatus in which a toner image is formed when an intermediate transfer member or a recording-material conveying member is separated from part of a plurality of image bearing members and the transfer method is determined using the ATVC technique.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. An image forming apparatus comprising:

a belt member configured to bear a recording material or a toner image;

a first image bearing member;

a first transfer member configured to transfer a toner image from the first image bearing member toward the belt member;

a second image bearing member;

a second transfer member configured to transfer a toner image from the second image bearing member toward the belt member;

a first sensing portion configured to sense a current passing through the first transfer member when a voltage is applied to the first transfer member;

a second sensing portion configured to sense a current passing through the second transfer member when a voltage is applied to the second transfer member; and a controller configured to execute a first mode in which an image can be formed when the belt member is in contact with the first and second image bearing members and a second mode in which an image can be formed when the belt member is separated from the first image bearing member and is in contact with the second image bearing member;

wherein, with a predetermined timing, the first sensing portion senses a first current when the belt member is in contact with the first and second image bearing members, and the second sensing portion senses a second current when the belt member is separated from the first image bearing member and is in contact with the second image bearing member, and the controller is configured to set a voltage to be applied to the first transfer member during execution of the first mode, based on a current sensed by the second sensing portion in the second mode after the predetermined timing, the first current, and the second current.

2. The image forming apparatus according to claim 1, wherein the controller is configured to modify the voltage to be applied to the first transfer member during execution of the first mode, according to the number of an image formation of the first mode after the first sensing portion senses the first current and the second sensing portion senses the second current.

3. The image forming apparatus according to claim 1, wherein, with a predetermined timing, the second sensing portion sense a third current when the belt member is in contact with the first and second image bearing members, and the controller is configured to set a voltage to be applied to the second transfer member during execution of the first mode, based on a current sensed by the second sensing portion in the second mode after the predetermined timing, the second current, and the third current.

4. The image forming apparatus according to claim 1, wherein the first mode and the second mode are switchable by movement of part of the belt member.

5. An image forming apparatus comprising:

a belt member configured to bear a recording material or a toner image;

a first image bearing member;

a first transfer member configured to transfer the toner image from the first image bearing member toward the belt member;

a second image bearing member;

a second transfer member configured to transfer the toner image from the second image bearing member toward the belt member;

a sensing portion configured to sense a current passing through the second transfer member when a voltage is applied to the second transfer member; and a controller configured to execute a first mode in which an image can be formed when the belt member is in contact with the first and second image bearing members and a second mode in which an image can be formed when the belt member is separated from the first image bearing member and is in contact with the second image bearing member;

wherein, with a predetermined timing, the sensing portion senses a first current when the belt member is in contact with the first and second image bearing members, and the sensing portion senses a second current when the belt member is separated from the first image bearing member and is in contact with the second image bearing member, and the controller is configured to set a voltage to be applied to the second transfer member during execution of the first mode, based on a current sensed by the sensing portion in the second mode after the predetermined timing, the first current, and the second current.

6. The image forming apparatus according to claim 5, wherein the first mode and the second mode are switchable by movement of part of the belt member.

7. An image forming apparatus comprising:

a belt member configured to bear a recording material or a toner image;

a first image bearing member;

a first transfer member configured to transfer the toner image from the first image bearing member toward the belt member;

a second image bearing member;

a second transfer member configured to transfer the toner image from the second image bearing member toward the belt member;

a sensing portion configured to sense a current passing through the second transfer member when a voltage is applied to the second transfer member;

a controller configured to execute a first mode in which an image can be formed when the belt member is in contact with the first and second image bearing members and a second mode in which an image can be formed when the belt member is separated from the first image bearing member and is in contact with the second image bearing member; and wherein, with a predetermined timing, the sensing portion senses a first current when the belt member is in contact with the first and second image bearing members, and the sensing portion senses a second current when the belt member is separated from the first image bearing member and is in contact with the second image bearing member, and the controller is configured to set a voltage to be applied to the second transfer member during execution of the second mode, based on a current sensed by the sensing portion in the first mode after the predetermined timing, the first current, and the second current.

8. The image forming apparatus according to claim 7, wherein the first mode and the second mode are switchable by movement of part of the belt member.

* * * * *